US010288053B2

(12) United States Patent
Chen

(10) Patent No.: US 10,288,053 B2
(45) Date of Patent: May 14, 2019

(54) ENERGY-SAVING SINGLE-DIMENSIONAL COMPRESSOR

(71) Applicant: Xiaohui Chen, Zhejiang (CN)

(72) Inventor: Xiaohui Chen, Zhejiang (CN)

( * ) Notice: Subject to any disclaimer, the term of this patent is extended or adjusted under 35 U.S.C. 154(b) by 7 days.

(21) Appl. No.: 15/656,038

(22) Filed: Jul. 21, 2017

(65) Prior Publication Data

US 2017/0363075 A1 Dec. 21, 2017

Related U.S. Application Data

(63) Continuation of application No. PCT/CN2016/000087, filed on Feb. 19, 2016.

(30) Foreign Application Priority Data

Mar. 6, 2015 (CN) ..... 2015 1 0105396

(51) Int. Cl.

| | |
|---|---|
| ***F04B 39/00*** | (2006.01) |
| ***F04B 35/01*** | (2006.01) |
| ***F04B 41/02*** | (2006.01) |
| ***F04B 39/06*** | (2006.01) |
| ***F04B 39/12*** | (2006.01) |

(52) U.S. Cl.

CPC ..... *F04B 39/0005* (2013.01); *F04B 35/01* (2013.01); *F04B 39/06* (2013.01); *F04B 39/121* (2013.01); *F04B 41/02* (2013.01)

(58) Field of Classification Search

CPC ..... F04B 39/005; F04B 39/10; F04B 39/121; F04B 35/01; F04B 53/146; F04B 53/147; F04B 9/04; F01B 7/00

USPC ..... 417/328, 415, 489; 92/109, 110

See application file for complete search history.

(56) References Cited

U.S. PATENT DOCUMENTS 1,566,442 A * 12/1925 Stancliffe ..... F04B 39/0005 417/486

* cited by examiner

*Primary Examiner* — Kenneth J Hansen

(74) *Attorney, Agent, or Firm* — Wayne & Ken, LLC; Tony Hom

(57) ABSTRACT

The present invention discloses an energy-saving one-dimensional compressor, comprising an air compressor, a fixing rod, a bearing plate, a condensing tube and a driving device. The air compressor comprises an inner shell and an outer shell; the inner shell comprises an upper pressing plate and a cylindrical plate; a top of the cylindrical plate is fixed under the upper pressing plate; an air inlet is formed at an upper part of the outer shell; part of a bottom of the outer shell protrudes downwards to form a cylindrical plate slot corresponding to the cylindrical plate; and the cylindrical plate can move up and down in the cylindrical plate slot. An air outlet is also formed at the bottom of the outer shell. The present invention has the beneficial effects of simple structure and high energy utilization rate.

1 Claim, 2 Drawing Sheets

ENERGY-SAVING SINGLE-DIMENSIONAL COMPRESSOR

TECHNICAL FIELD

The present invention relates to a compressor technology, and particularly relates to an one-dimensional compressor.

BACKGROUND

A compressor is a machine that compresses gas and increases pressure of the gas, and is widely applied. Common application fields include: heating, ventilation and air conditioning, refrigerating cycle, supply of industrial driving power, silicon chemical engineering, petrochemical chemical engineering, natural gas transportation, etc. Based on operation principles, the compressor can be classified into a positive-displacement compressor and an aerodynamic compressor.

SUMMARY

The purpose of the present invention is to provide an energy-saving one-dimensional compressor, so as to solve the technical defects of excessively complex structure and low energy utilization rate in the prior art.

To solve the above technical problem, a technical solution adopted by the present invention is that: An energy-saving one-dimensional compressor comprises an inner shell, an outer shell, a fixing rod, a bearing plate, a condensing tube and a driving device.

The inner shell comprises an upper pressing plate and a cylindrical plate; a top of the cylindrical plate is fixed under the upper pressing plate; a caliber of the cylindrical plate is smaller than a width of the upper pressing plate; an air inlet is formed at an upper side wall of the outer shell; a cylindrical plate slot corresponding to and accommodating the cylindrical plate is provided at a bottom of the outer shell; and the cylindrical plate moves up and down in the cylindrical plate slot during compressing. An air outlet is also formed at the bottom of the outer shell. The inner shell is arranged in the outer shell, and a side surface of the upper pressing plate is bonded with an inner wall of an upper side wall of the outer shell. The cylindrical plate, the upper pressing plate and the bottom of the outer shell are encircled to form a main air chamber. An outer wall of the cylindrical plate, the upper pressing plate, the bottom of the outer shell and the upper side wall of the outer shell are encircled to form an auxiliary air chamber.

The top of the fixing rod is fixed under the upper pressing plate; the interior of the fixing rod is hollow; the top of the bearing plate is fixedly connected with the bottom of the fixing rod, and the interior of the bearing plate is hollow; a side surface of the bearing plate is bonded with an inner wall of the air outlet; and the top end of the condensing tube is fixedly connected with an outer wall of the air outlet.

The driving device comprises a first motor, a first gear, a first dowel bar and a first rack arranged on the first dowel bar; a bottom of the first dowel bar is fixed above the upper pressing plate; the first rack is engaged with the first gear; and the first motor can drive the first gear to rotate.

The present invention has the beneficial effects of simple structure and high energy utilization rate.

DETAILED DESCRIPTION

Specific embodiments of the present invention will be further described below in combination with drawings.

Figure 1:
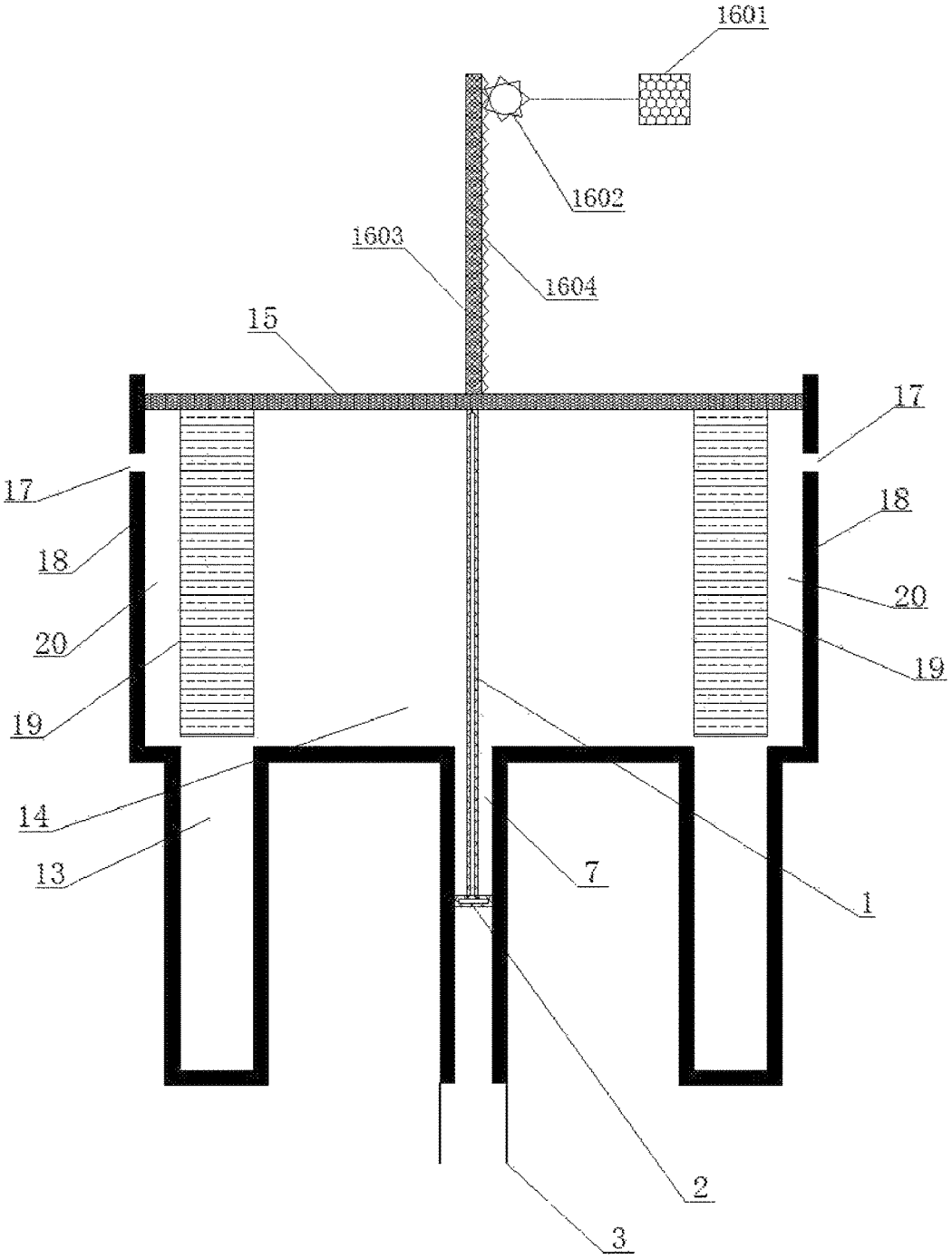
FIG. 1 is a structural schematic diagram of an one-dimensional compressor.

The energy-saving one-dimensional compressor shown in FIG. 1 comprises an inner shell, an outer shell 18, a fixing rod 1, a bearing plate 2, a condensing tube 3 and a driving device.

Figure 2:
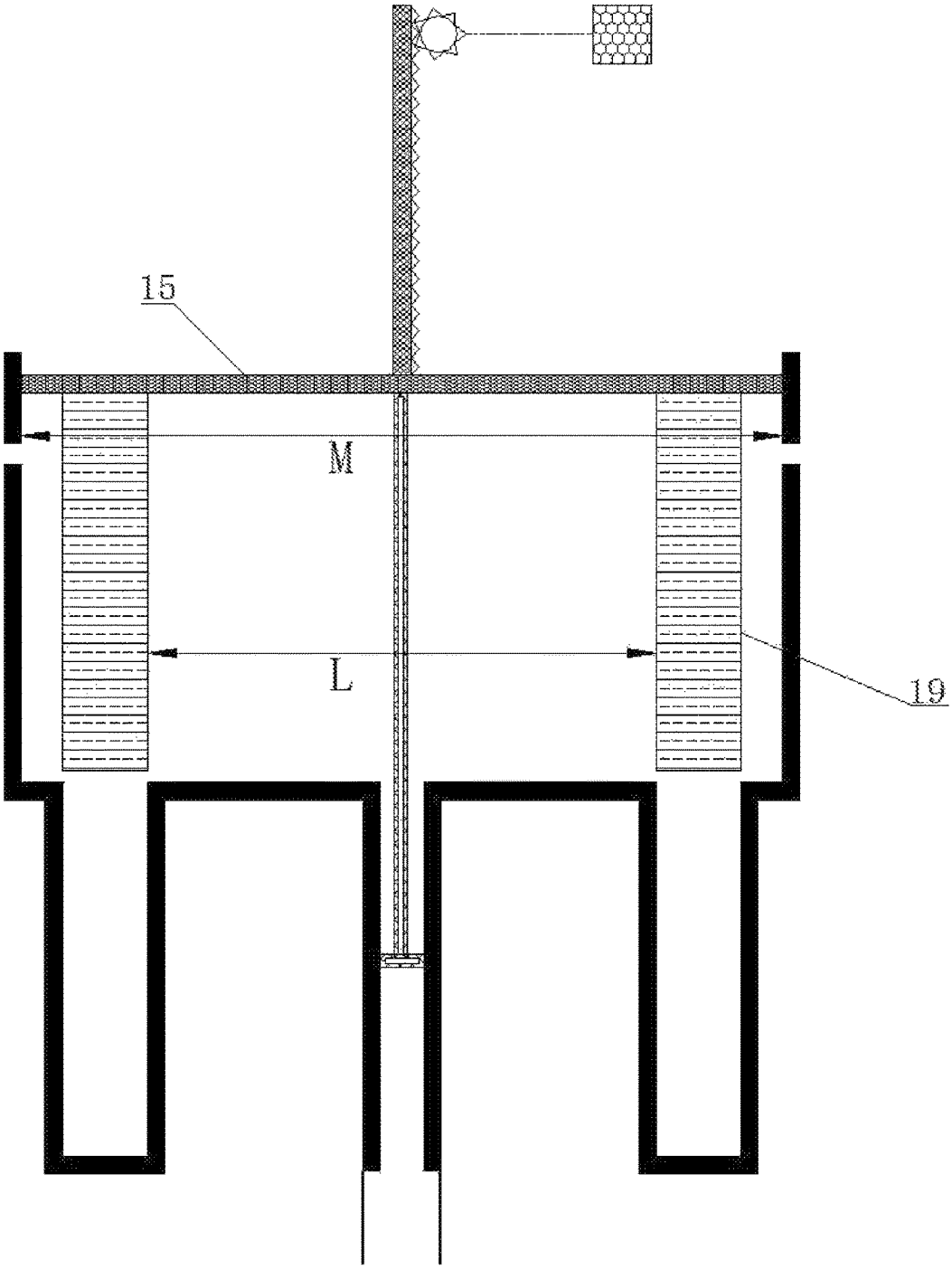
FIG. 2 is a dimensional schematic diagram of some components of an one-dimensional compressor.

The inner shell comprises an upper pressing plate 15 and a cylindrical plate 19; a top of the cylindrical plate 19 is fixed under the upper pressing plate 15; a caliber L of the cylindrical plate 19 is smaller than a width M of the upper pressing plate (15) (as shown in FIG. 2); an air inlet 17 is formed at an upper side wall of the outer shell 18; a cylindrical plate slot corresponding to and accommodating the cylindrical plate is provided at a bottom of the outer shell 18; the cylindrical plate 19 moves up and down in the cylindrical plate slot 13 during compressing; an air outlet 7 is also formed at the bottom of the outer shell 18; the inner shell is arranged in the outer shell 18; and a side surface of the upper pressing plate 15 is in close contact with an inner wall of an upper side wall of the outer shell 18. The cylindrical plate 19, the upper pressing plate 15 and the bottom of the outer shell 18 are encircled to form a main air chamber 14; and an outer wall of the cylindrical plate 19, the upper pressing plate 15, the bottom of the outer shell 18 and the upper side wall of the outer shell 18 are encircled to form an auxiliary air chamber 20.

The top of the fixing rod 1 is fixed under the upper pressing plate 15; the interior of the fixing rod 1 is hollow; the top of the bearing plate 2 is fixedly connected with the bottom of the fixing rod 1, and the interior of the bearing plate 2 is hollow; a side surface of the bearing plate 2 is in close contact with an inner wall of the air outlet 7; and the top end of the condensing tube 3 is fixedly connected with an outer wall of the air outlet 7.

The driving device comprises a first motor 1601, a first gear 1602, a first dowel bar 1603 and a first rack 1604 arranged on the first dowel bar 1603; a bottom of the first dowel bar 1603 is fixed above the upper pressing plate 15; the first rack 1604 is engaged with the first gear 1602; and the first motor 1601 can drive the first gear 1602 to rotate.

A specific operation process of the present invention is as follows:

1. Outside gas successively enters the auxiliary air chamber 20, the cylindrical plate slot 13 and the main air chamber 14 from the air inlet 17.

2. After started, the first motor 1601 drives the first dowel bar 1603 to move down, and the upper pressing plate 15 also moves down with the first dowel bar 1603 and compresses gas in the auxiliary air chamber 20, the cylindrical plate slot 13 and the main air chamber 14; and the compressed gas enters the air outlet 7.

3. When the bearing plate 2 moves down to the lower part of the air outlet 7, high-pressure gas sprays from the end of the air outlet 7 and enters the condensing tube 3. The high-pressure gas expands and then absorbs heat.

4. After started reversely, the first motor 1601 drives the first dowel bar 1603 to move up, and the upper pressing plate 15 also moves up with the first dowel bar 1603 and returns to an original position.

Part of the above description not particularly explained belongs to the prior art or can be realized through the prior art. Any equivalent variation and modification made in accordance with contents of the scope of the application patent of the present invention shall belong to the technical field of the present invention.

What is claimed is:

1. A one-dimensional compressor, comprising an inner shell, an outer shell, a fixing rod, a bearing plate, a condensing tube and a driving device, wherein the inner shell comprises an upper pressing plate and a cylindrical plate; a top of the cylindrical plate is fixed under the upper pressing plate; a caliber of the cylindrical plate is smaller than a width of the upper pressing plate; an air inlet is formed at an upper side wall of the outer shell; a cylindrical plate slot corresponding to and accommodating the cylindrical plate is provided at a bottom of the outer shell; the cylindrical plate moves up and down in the cylindrical plate slot during compression; an air outlet is formed at the bottom of the outer shell; the inner shell is arranged in the outer shell; a side surface of the upper pressing plate is in contact with an inner wall of the upper side wall of the outer shell; the cylindrical plate, the upper pressing plate and the bottom of the outer shell are encircled to form a main air chamber; and an outer wall of the cylindrical plate, the upper pressing plate the bottom of the outer shell and the upper side wall of the outer shell are encircled to form an auxiliary air chamber;

a top of the fixing rod is fixed under the upper pressing plate; a top of the bearing plate is fixedly connected with a bottom of the fixing rod; a side surface of the bearing plate is in contact with an inner wall of the air outlet; a top end of the condensing tube is fixedly connected with an outer wall of the air outlet;

the driving device comprises a first motor, a first gear, a first dowel bar and a first rack arranged on the first dowel bar; a bottom of the first dowel bar is fixed above the upper pressing plate; the first rack is engaged with the first gear; and the first motor drives the first gear to rotate.

* * * * *